US007434959B1

(12) United States Patent
Wang

(10) Patent No.: US 7,434,959 B1
(45) Date of Patent: Oct. 14, 2008

(54) LED LAMP DEVICE

(75) Inventor: Pei-Choa Wang, Gueishan Township, Taoyuan County (TW)

(73) Assignee: Augux Co., Ltd., Taoyuan (TW)

( * ) Notice: Subject to any disclaimer, the term of this patent is extended or adjusted under 35 U.S.C. 154(b) by 0 days.

(21) Appl. No.: 11/838,336

(22) Filed: Aug. 14, 2007

(51) Int. Cl.
*F21V 21/00* (2006.01)

(52) U.S. Cl. ..... 362/249; 362/218; 362/294

(58) Field of Classification Search ..... 362/240, 362/249, 294, 373, 218
See application file for complete search history.

(56) References Cited

U.S. PATENT DOCUMENTS 6,871,993 B2 * 3/2005 Hecht ..... 362/555
7,314,291 B2 * 1/2008 Tain et al. ..... 362/294
2007/0070628 A1 * 3/2007 Chen ..... 362/249
2008/0002399 A1 * 1/2008 Villard et al. ..... 362/184
2008/0080188 A1 * 4/2008 Wang ..... 362/294

* cited by examiner

*Primary Examiner*—John A Ward

(57) ABSTRACT

An LED lamp device has a lamp seat, in which a lamp trough is formed by being recessed inwardly, and the inner edge surface of the lamp seat is formed as an arc surface. The front and rear parts in longitudinal direction of the lamp trough are also bent inwardly. Three rows of lamp set are arranged along the longitudinal sides in the lamp trough. These lamp sets have a plurality of LEDs as light-emitting elements. The lamp sets at left and right rows are inclined inwardly according to the curvature of the inner edge surface. In the meantime, the lamp sets at front and rear sides of one row are also inclined inwardly. Under this arrangement, the plural lamp sets not only can enhance the illumination of the lamp, but also can concentrate its light-emitting operation, for solving a shortcoming of light dispersal in most light sources.

13 Claims, 7 Drawing Sheets

LED LAMP DEVICE

BACKGROUND OF THE INVENTION

1. Field of the Invention

The present invention generally relates to a lamp, in particular, to a lamp device taking Light-Emitting Diode (LEDs) as light-emitting elements.

2. Description of Prior Art

It is no doubt that LED has become one of the products attracting most attention in recent years, thanks to its advantages of low pollution and high illumination. Besides, the light-emitting effect of an LED is uneasy to disperse, compared with that of traditional light-emitting element. Thereby, LED is not only comprehensively applied to most illuminating devices, but also applied to outdoor streetlamp recently.

Since the purpose of a streetlamp installed along a roadside is to guide people and vehicle, so its illuminating need is more severe than that of an indoor lamp. In the meantime, since of outdoor installment, LED streetlamp must be able to provide same illumination even in facing different weather conditions. In a traditional streetlamp device, a single light-emitting element is used as light source reflected by lampshade to extend its illuminating range. Even being reflected by the lampshade, the light source generated from a traditional light-emitting element is still easily dispersed, so its illuminating effect is limited, particularly, under unstable weather conditions, the illuminating effect of the streetlamp being frequently influenced by mist or rain so greatly that it becomes too vague to develop fully.

The advantage of LED can compensate the inferiority of traditional light-emitting element, besides overcoming the shortcoming of lighting dispersal, LED further being able to provide people or driver with excellently guiding effect under an awful weather, and this is a reason why LED becomes a major light-emitting element for current streetlamp device.

Although LED has the advantage of uneasy dispersal in terms of a light source, a streetlamp further needs a large range of illumination, besides a strong illumination. So, in a well-known structure of LED streetlamp, a plurality of LEDs are adopted in a formation of two rows to enhance its light-emitting illumination. In the meantime, a lampshade arranged in the lamp is cooperated to reflect and focus the light beam to augment its illuminating range.

In the aforementioned structure, although the plural LEDs are adopted as light source and its light-emitting illumination is sufficient to provide a large area of illuminating range, the light source generated from the LEDs in a formation of two rows still can not be totally reflected via the lampshade, due to a poor design of the lampshade in prior structure. In this case, the illuminating area of the lamp is unable to be extended in corresponding to the illuminating enhancement of the light source. In other words, the illuminating efficiency of the lamp is unable to be augmented in corresponding to the number increase of the light source, which on the other hand becomes a sort of resource waste. Thus, an alternative has to be sought for improving such kind of inferiority in the prior structure.

SUMMARY OF THE INVENTION

The invention is mainly to provide an LED lamp device capable of focusing light sources, by arranging three rows of LED lamp sets as light-emitting source in a lampshade improved with curved angles, making the light-emitting pathways of these three rows of LED lamp sets may be focused, so not only the problem of the light-source dispersal caused by the flatness of lampshade is solved, but also the light-emitting performance is also improved by reflecting the light-emitting sources completely.

The invention is to provide an LED lamp device having a lamp seat, in which a lamp trough is formed by being recessed inwardly, and the inner edge surface of the lamp seat is formed as an arc surface. The front and rear parts in longitudinal direction of the lamp trough are also bent inwardly. Three rows of lamp set are arranged along the longitudinal sides in the lamp trough. These lamp sets have a plurality of LEDs as light-emitting elements. The lamp sets at left and right rows are inclined inwardly according to the curvature of the inner edge surface. In the meantime, the lamp sets at front and rear sides of one row are also inclined inwardly. Under this arrangement, the plural lamp sets not only can enhance the illumination of the lamp, but also can concentrate its light-emitting operation, for solving a shortcoming of light dispersal in most light sources.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
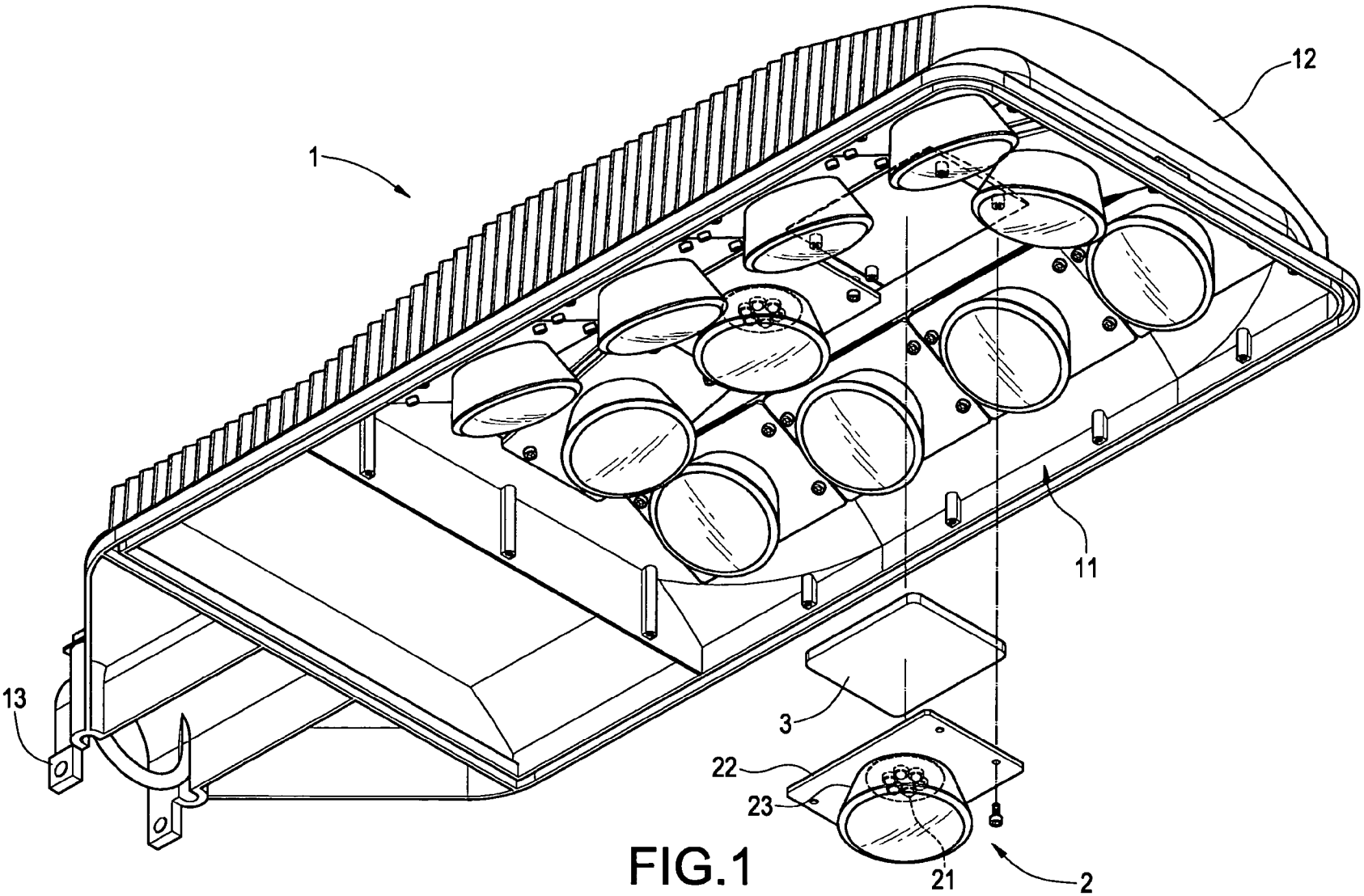
FIG. 1 is a perspective, explosive view of the structure of the present invention.

Please refer to FIG. 1, which is a perspective, explosive view of the structure of the present invention. As shown in this figure, a lamp device of the present invention mainly includes a lamp seat 1, which is shown as a rectangular casing integrally die-cast from an aluminum material. The bottom surface of the lamp seat 1 is recessed inwardly to form a lamp trough 11, which is shown as an arc surface in this embodiment and can be best shown in FIG. 6, which is a partially cross-sectional view of the present invention. The longitudinal sides of the lamp trough 11 are also bent inwardly to make the inner edge surface of the lamp trough 11 shown as an inclined shape best shown in FIG. 7, which is a partially longitude-sectional view of the present invention. The top part of the lamp seat 1 is arranged a plurality of cooling pieces 12, which are interspaced to each other to help light-emitting elements in the lamp seat 1 undertake a cooling operation. A pivoting seat 13 is arranged at the rear side of the lamp seat 1.

Figure 6:
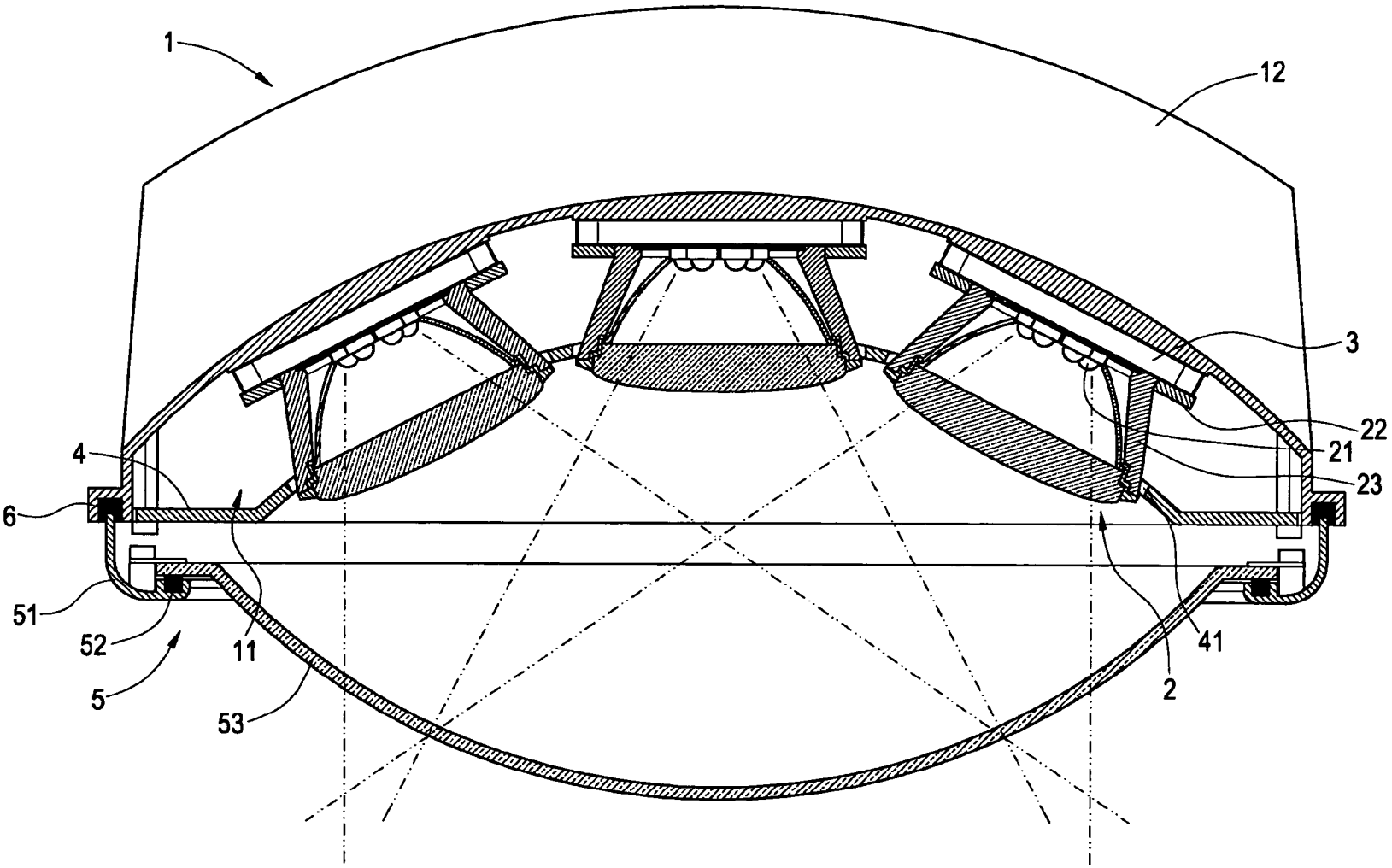
FIG. 6 is a partially cross-sectional view of the present invention.
Figure 7:
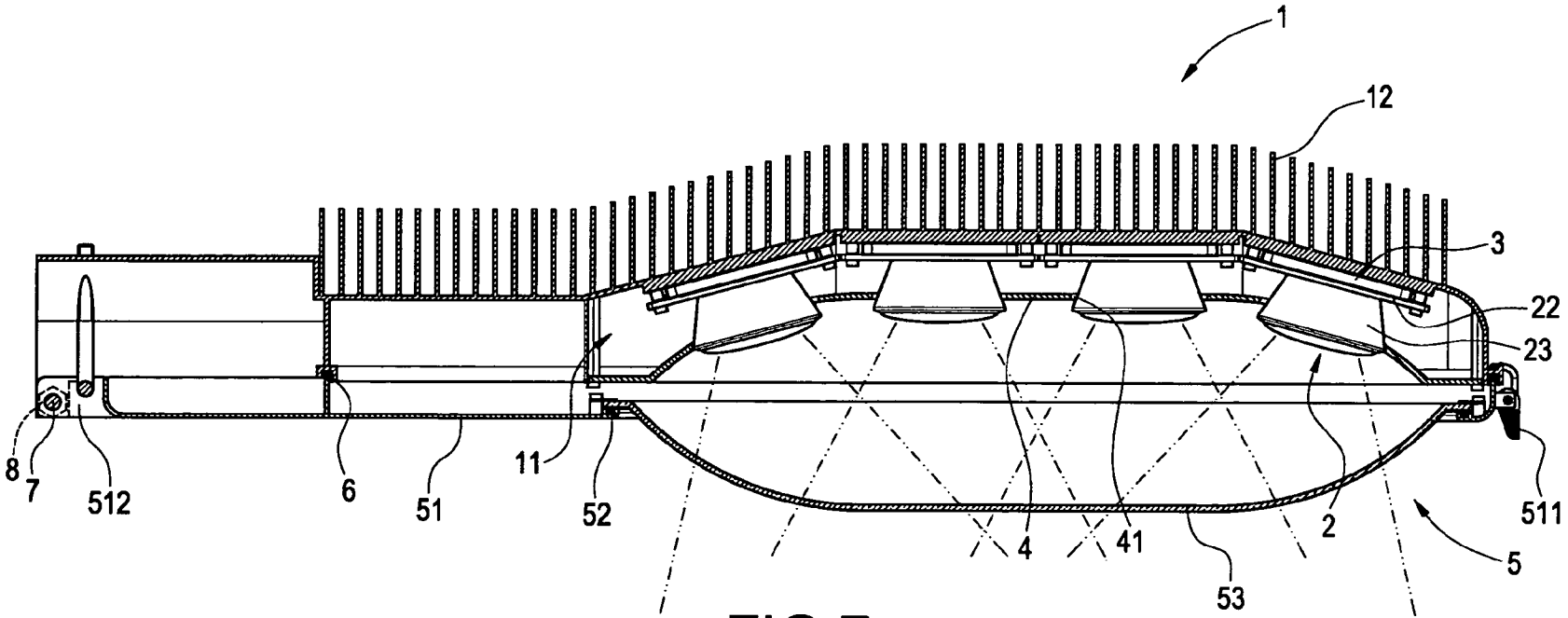
FIG. 7 is a partially longitude-sectional view of the present invention.

The interior of the lamp trough 11 is arranged a plurality of lamp sets 2, which are in a formation of three rows arranged along the longitudinal sides of the lamp trough 11, and the left and right rows of which emit light centrally owing to the curvature of the inner edge surface of the lamp trough 11, as best shown in FIG. 6, which is a partially cross-sectional view of the present invention. The lamp sets 2 at the front and rear side of a same row also emit light inwardly, because the front and rear sides of the inner edge surfaces of the lamp trough 11 are also bent inwardly, as best shown in FIG. 7, which is a partially longitude-sectional view of the present invention. In addition, each lamp set 2 includes a plurality of light-emitting elements 21, which are LEDs in this embodiment. The light-emitting elements 21 are arranged on a substrate 22, above which a bowl-shaped lamp mask 23 is connected thereon to enclose these light-emitting elements 21 therein, thus a light source generated from these light-emitting elements 21 being reflected out by the lamp mask 23. Another side of the substrate 22 is connected to a temperature-constant plate 3 and is locked to the inner edge surface of the lamp trough 11, making the heat to be generated from these LEDs 21 in the lamp set 2 transferred to the temperature-constant plate 3 via the substrate 22 and finally dissipated to the ambience through the plural cooling pieces 12 arranged at the back of the lamp seat 1.

Figure 2:
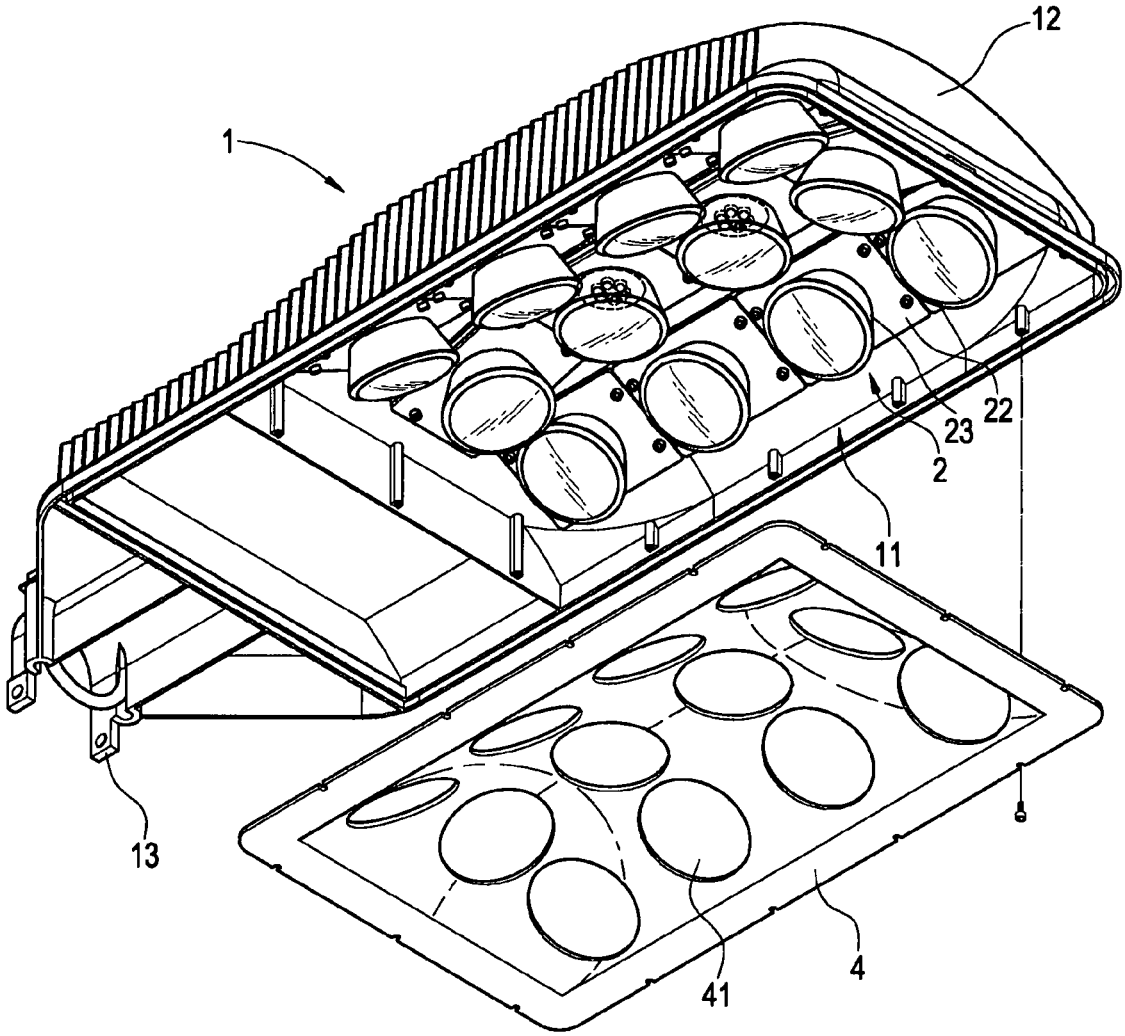
FIG. 2 is an illustration of an assembled lamp of the present invention.

Please refer to FIG. 2, which is an illustration of an assembled lamp of the present invention. As shown in this figure, the interior of the lamp trough 11 is correspondingly arranged a reflecting plate 4, and a plurality of openings 41 are arranged thereon. The lamp mask 23 of the lamp set 2 is just arranged through each opening 41 correspondingly, when the reflecting plate 4 is connected into the lamp trough 11.

Figure 3:
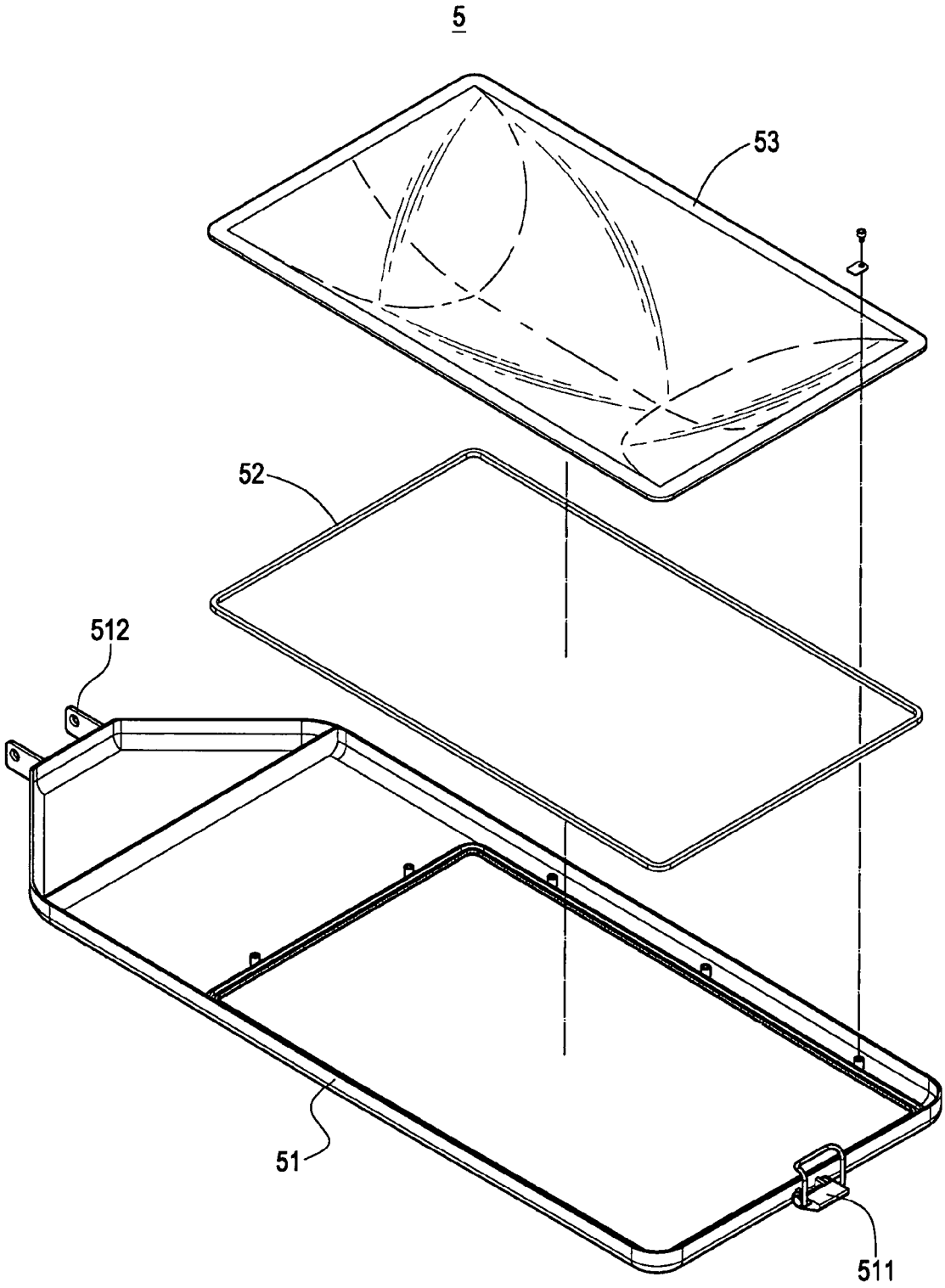
FIG. 3 is a structurally explosive view of the mask body of the present invention.
Figure 4:
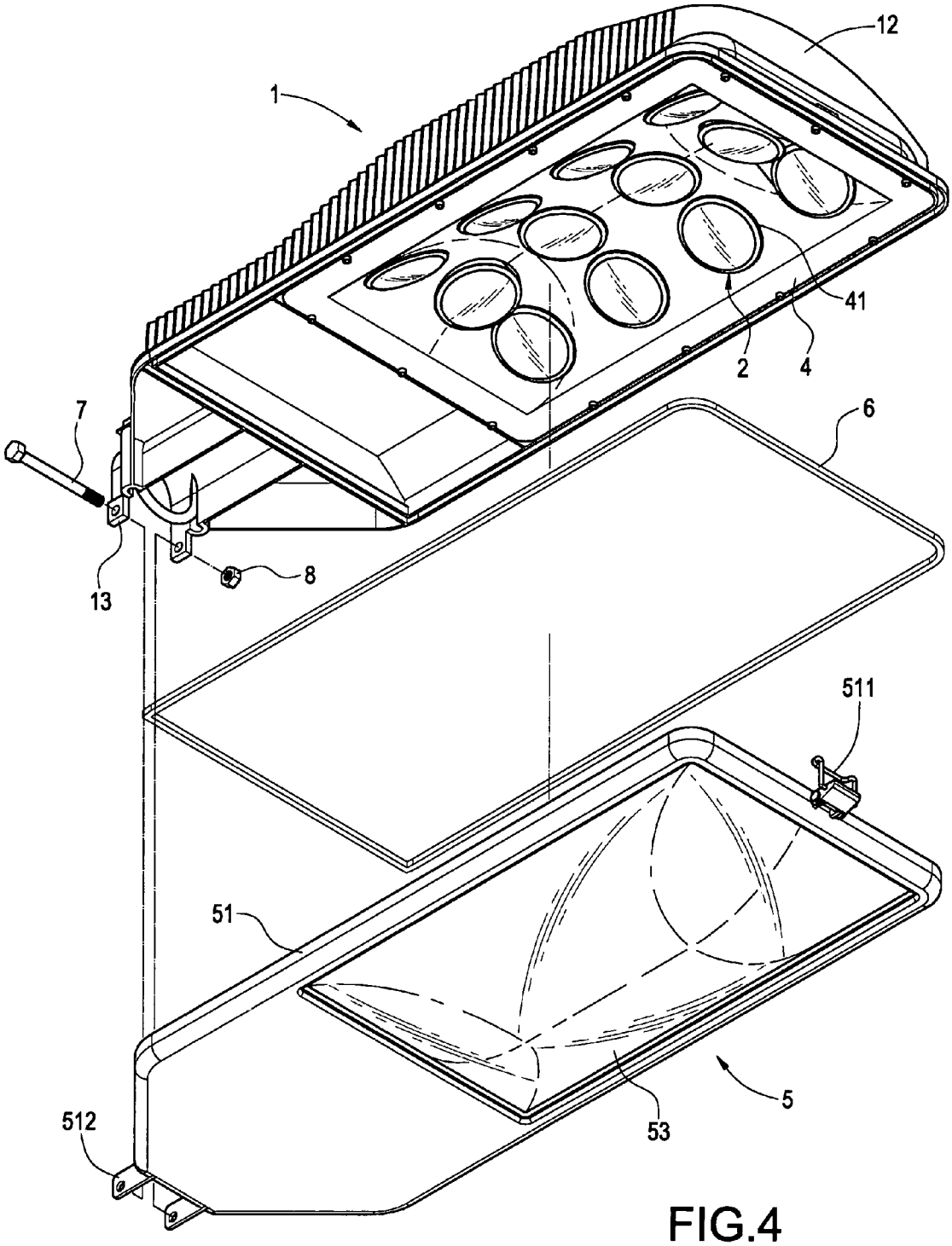
FIG. 4 is an assembled illustration of the present invention.
Figure 5:
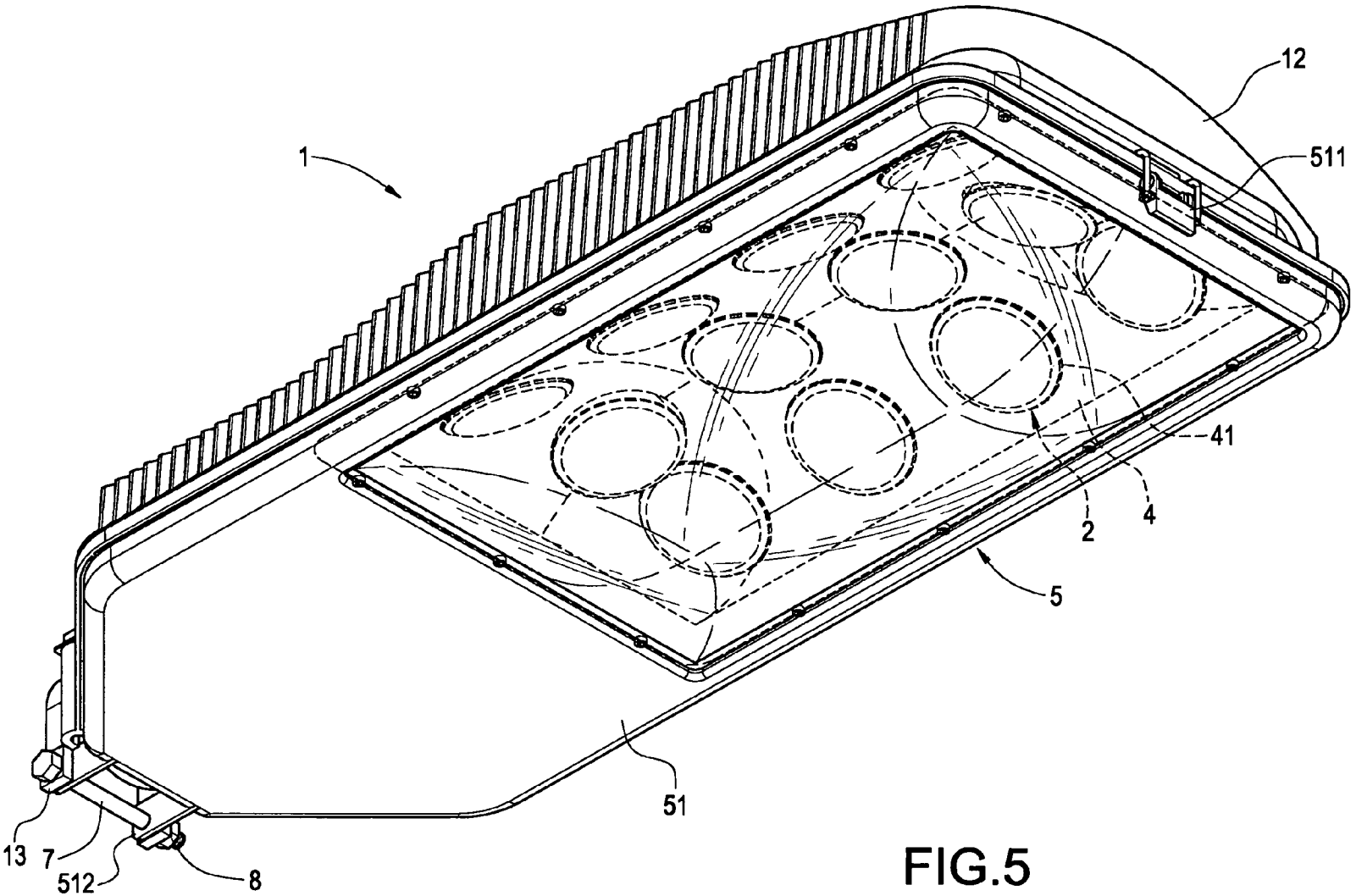
FIG. 5 is an assembled, completed view of the present invention.

Please refer to FIG. 3 and FIG. 4, which respectively are a structurally explosive view and an assembled illustration of the mask body of the present invention. As shown in these figures, the lamp seat 1 is correspondingly connected to a transparent mask body 5, which includes a frame body 51, the front side of which a fastener is arranged for being fastened itself on the lamp seat 1. A connecting seat 512 is arranged at the rear side of the frame body 51. Furthermore, a frame strip 52 is correspondingly arranged around the circumference of the frame body 51, which is finally connected to a transparent plate 53, making the frame strip 52 sandwiched between the frame body 51 and the transparent plate 53. When the mask body 5 and the lamp seat 1 is connected correspondingly, a water-proof frame strip 6 is arranged around the circumference, where the lamp seat 1 and the mask body 5 are connected, making the water-proof strip 6 sandwiched therein after the lamp seat 1 and the mask body 5 are connected correspondingly. In addition, a pivoting seat 13 arranged at the rear side of the lamp seat 1 and the connecting seat 512 arranged at the rear side of the mask body 5 are interconnected together, by arranging a bolt 7 and a nut 8 for securing the pivoting seat 13 and the mask body 5 together. The assembled, completed view is shown in FIG. 5.

Please refer to FIG. 6 and FIG. 7, which respectively are a partially cross-sectional view and a partially longitude-sectional view the present invention. As shown in these figures, three rows of lamp sets 2 are arranged in the lamp trough 11. In cooperation of the curvature design of the inner edge surface of the lamp trough 11, the illuminating angles of the lamp sets 2 are concentrated centrally without the occurrence of light-dispersing phenomenon, because the light-emitting pathway generated from each lamp set 2 is centralized. In addition, since the lamp sets 2 arranged at the front and rear sides of a same row are influenced by the inward curvature of the inner edge surface of the lamp trough 11, the illuminating angles of these lamp sets 2 are also biased inwardly, as shown in FIG. 7, such that the light-emitting pathways generated from these lamp sets 2 are concentrated without occurring a light-dispersing phenomenon.

However, the aforementioned description is only a preferable embodiment according to the present invention, being not used to limit the patent scope of the invention, so equivalently structural variation made to the contents of the present invention, for example, description and drawings, is all covered by the claims claimed thereinafter.

What is claimed is:

1. An Light-Emitting Diode (LED) lamp device, comprising:

a lamp seat, in which a lamp trough is formed by being recessed inwardly, and a front and a rear in a longitudinal direction of the lamp trough being also bent inwardly and shown as inclined shapes; and a plurality of lamp sets, in each of which a plurality of LEDs are arranged, and which are arranged in a formation of three rows along the longitudinal direction in the lamp trough, two outer rows being inclined inwardly in corresponding to curvedly inner edge surfaces of the lamp trough, the lamp sets arranged in the front and the rear of each row being also inclined inwardly.

2. The LED lamp device according to claim 1, wherein a plurality of cooling pieces are arranged at a top of the lamp seat.

3. The LED lamp device according to claim 1, wherein the lamp seat is integrally constructed by die-casting an aluminum material.

4. The LED lamp device according to claim 1, wherein the lamp set further includes a substrate, on which the plural LEDs are arranged, and to which a lamp mask is also connected to enclose the plural LEDs therein.

5. The LED lamp device according to claim 4, wherein another side of the substrate is further connected to a temperature-constant plate, which is locked to the lamp trough together with the substrate.

6. The LED lamp device according to claim 1, wherein an interior of the lamp trough is further connected to a reflecting plate correspondingly, on which a plurality of openings are arranged, making a lamp mask of each lamp set just correspond to each opening, when the reflecting plate is connected to the lamp trough.

7. The LED lamp device according to claim 1, wherein the lamp seat is further connected to a mask body correspondingly.

8. The LED lamp device according to claim 7, wherein the mask body is comprised of a frame body, a frame strip and a transparent plate, the frame strip being sandwiched between the frame body and the transparent plate, when the frame body and the transparent plate are connected correspondingly.

9. The LED lamp device according to claim 8, wherein one side of the frame body is arranged a fastener, which is for connecting the mask body to the lamp seat.

10. The LED lamp device according to claim 8, wherein another side of the frame body is arranged a connecting seat, while another side of the lamp seat is arranged a pivotal seat, which is connected to the connecting seat correspondingly.

11. The LED lamp device according to claim 10, wherein the connecting seat and the pivotal seat are secured by a bolt and a nut.

12. The LED lamp device according to claim 7, wherein a water-proof frame strip is arranged between the lamp seat and the mask body, making the water-proof frame strip sandwiched therein, when the lamp seat and the mask body are connected correspondingly.

13. The LED lamp device according to claim 1, wherein the inner edge surface is shown as an arc shape.

* * * * *